US005540218A

United States Patent [19]

Jones et al.

[11] Patent Number: 5,540,218

[45] Date of Patent: Jul. 30, 1996

[54] RESPIRATORY SYSTEM PARTICULARLY SUITED FOR AIRCREW USE

[75] Inventors: Timothy J. Jones, Phoenixville, Pa.; John E. Hollingsworth, Austin, Tex.

[73] Assignee: The United States of America as represented by the Secretary of the Navy, Washington, D.C.

[21] Appl. No.: 310,539

[22] Filed: Dec. 5, 1994

[51] Int. Cl.[6] ..... A62B 17/04

[52] U.S. Cl. ..... 128/201.24; 128/204.26; 128/205.11; 128/205.24

[58] Field of Search ..... 128/201.28, 204.26, 128/205.11, 205.24

[56] References Cited

U.S. PATENT DOCUMENTS

| | | | |
|---|---|---|---|
| 3,307,540 | 3/1967 | Link | 128/201.29 |
| 4,273,120 | 6/1981 | Oswell | 128/204.26 |
| 4,741,332 | 5/1988 | Beaussant | 128/204.26 |
| 4,819,626 | 4/1989 | Himmens | 128/204.26 |
| 5,027,807 | 7/1991 | Wise et al. | 128/201.28 |
| 5,127,398 | 7/1992 | Stone | 128/204.26 |

*Primary Examiner*—Aaron J. Lewis
*Attorney, Agent, or Firm*—Susan E. Verona

[57] ABSTRACT

A respiratory system that is particularly suited to provide uncontaminated ventilation and oxygen needs of an aircrew during the ground and flight operations is disclosed. The respiratory system has provisions to provide for a continuous flow of air or oxygen during the failure mode conditions of the ventilator and oxygen generating systems supplying the respiratory system so that the aircrew is always provided with at least a flow of uncontaminated breathing fluid under all such failure mode conditions.

10 Claims, 5 Drawing Sheets

RESPIRATORY SYSTEM PARTICULARLY SUITED FOR AIRCREW USE

STATEMENT OF GOVERNMENT INTEREST

The invention described herein may be manufactured and used by or for the government of the United States of America, for governmental purposes, without the payment of any royalty thereon or therefor.

BACKGROUND OF THE INVENTION

The present invention relates to a respiratory system for providing chemical and biological (CB) protection, ventilation, and delivering oxygen to a user and, more particularly, to a respiratory system that provides CB protection, ventilation, and delivers oxygen to an aircrew and that is self-contained and portable, and has provisions for providing either a flow of oxygen or a flow of air during the failure conditions of the ventilation and oxygen supplying systems.

Respiratory systems that provide CB protection, ventilation, and deliver oxygen to an a aircrew during ground and flight operations normally comprise a hood and mask assembly that cover the head and neck and has an optically clear face piece that covers the eyes of the aircrew. Such known respiratory systems suffer a drawback by requiring aircraft modifications, and by lacking provisions to accommodate for failure mode conditions of the ventilation and oxygen systems supplying the respiratory system, and by requiring multiple steps to select various operating modes. More particularly, these known respiratory systems do not provide continuous self-contained operation and allow the aircrew to be deprived of a flow of oxygen in the event of a failure of the oxygen supplying system or to be deprived of a flow of air in the event of a failure of the ventilator system. It is desired that means be provided for a continuous self-contained operation and to allow either a flow of air or a flow of oxygen to be delivered to the aircrew during the failure conditions involving either the oxygen or ventilation supply systems.

SUMMARY OF THE INVENTION

The present invention is directed to a CB protective, respiratory system which is self contained and portable, and has means for supplying either a flow of air or a flow of oxygen during the failure mode conditions of the oxygen and ventilation systems supplying the respiratory system.

The respiratory system comprises means for supplying a flow of oxygen, means for supplying a flow of air, a manifold, a hood, a mask, and fluid coupling means. The manifold has first, second, third and fourth ports, with the first and third serving as input ports and the second and fourth serving as output ports. The first and second ports each have a one-way flow valve. The manifold has a switch with means for carrying a duct that is selectable to establish fluid communications between the first and fourth ports and between the second and third ports. The hood covers the head and neck of the user, whereas a transparent window, carried by the hood, is arranged in the general region of the eyes of the user. The mask covers the mouth and nose of the user. The fluid coupling means couples the first port to the means for supplying a flow of air, the third port to the means for supplying a flow of oxygen, and both the second and fourth ports to the mask.

Accordingly, it is an object of the present invention to provide a respiratory system which is self contained and portable and that supplies either a flow of air or a flow of oxygen to a user during any of the failure mode conditions of the oxygen and ventilation systems supplying the respiratory system. The delivery of either the flow of air or the flow of oxygen to the respiratory system is selectable by a single switch that is conveniently located relative to the user.

It is a further object of the present invention to provide means that maintains the pressure of the hood under all conditions and that prevents the waste of oxygen in the event of ventilator system failure.

Still further, it is an object of the present invention to provide an aircrew with uncontaminated breathable air during an oxygen supply system failure.

Other objects, advantages and novel features of the invention will become apparent from the following detailed description when considered in conjunction with the accompanying drawings therein.

DETAILED DESCRIPTION OF THE PREFERRED EMBODIMENTS

Figure 1:
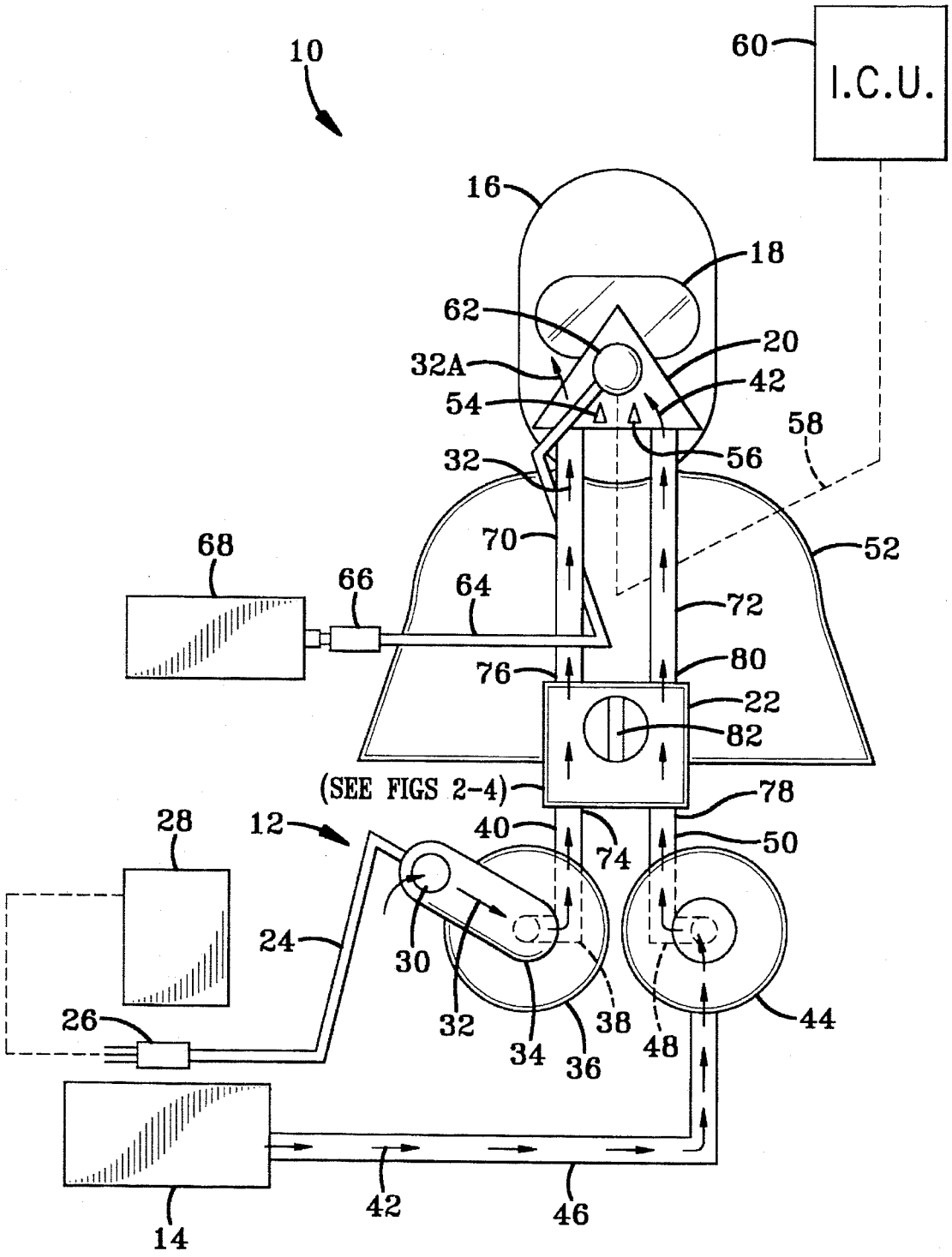
FIG. 1 is a schematic illustrating the interrelationship of the primary elements related to the present invention.

With reference to the drawings, wherein the same reference numbers indicate the same elements throughout, FIG. 1 illustrates a schematic of a respiratory system 10 of the present invention. The respiratory system 10 provides ventilation and delivers oxygen to a user, such as an aircrew, at sufficient pressures and flow rates, so that the aircrew may perform their needed tasks during both ground and flight operations. More importantly, and as will be described, the respiratory system 10 provides fluid communications in the form of a flow of air, or in the form of a flow of oxygen, during failure mode conditions of the ventilation or oxygen systems supplying the respiratory system 10. Also, the respiratory system 10 provides a self contained and portable ventilator system. The respiratory system 10 comprises a ventilator system 12 that supplies a flow of air, an oxygen supply system 14 that supplies a flow of oxygen, a hood 16 that carries a transparent window 18, a mask 20, and a manifold 22.

The ventilator system 12 is self contained and portable, which is meant to mean that the system is man mounted, provides all necessary modes of operation without reconfiguration of the fluid couplings and does not require significant aircraft modifications. The ventilator system 12 comprises an electric cord 24 having a connector 26 at one of its ends which is mated to a battery 28 that may be either of the chargeable or non-chargeable type. The battery 28 provides the electrical power to excite a fan blower 30 that creates a flow of air 32 which is directed by a plenum 34 into a filtering canister 36. A hose coupling adaptor 38 receives the flow of air 32 from the canister 36 and directs the flow of air 32 to the manifold 22 by way of fluid coupling means 40 which preferably is of a hose type coupling device that mates with complementary provisions of the device to which it is being connected. These hose type fluid coupling means are preferably used for all florid coupling means of FIG. 1 to interconnect the separated elements shown therein. As seen in FIG. 1, the flow of air 32 is directed from the manifold 22 to the mask 20 and a portion thereof, that is, flow of air 32A, is directed, relative to and into the hood 16. The hood 16 and mask 20 have separate chambers with the mask 20 being sealed on the face and holding pressures that are higher than those of the hood.

The oxygen supply system 14 comprises a regulator, sometimes referred to as an oxygen regulator, which is connected to a source of oxygen such as liquid oxygen, gaseous oxygen, or some other oxygen generation system commonly found aboard an aircraft. The oxygen regulator 14 supplies a flow of oxygen 42 that is routed to a filtering canister 44, by means of fluid coupling means 46. A hose coupling adaptor 48, accepts the flow of oxygen 42 from the canister 44 and directs the flow of oxygen 42 to the manifold 22 by way of fluid coupling means 50. As seen in FIG. 1, the flow of oxygen 42 is directed from the manifold 22 into the mask 20.

The hood 16 comes into contact with a vest 52 worn by the user, or aircrew, and covers and isolates the entire head and neck of the user from external environments. The hood 16 carries the transparent window 18, which is arranged in the general region of the eyes of the user, and preferably comprises a polycarbonate material. The hood 16, as well as the other components exposed to the environment, such as the transparent window 18, mask 20, manifold 22 and vest 52 are preferably resistant to permeation by chemical and biological agents, fuels, oils, lubricants, or perspiration; while at the same time, these materials are preferably compatible with 100% oxygen.

The mask 20 comprises a breathing compartment (not shown but known in the art) that includes separate ventilation/exhalation valves 54 and 56. The mask 20 further comprises the necessary valves, hoses and interface devices to provide the user with fluid communications with the filtered-blown flow of air 32 from the ventilating system 12 and with the filtered-blown flow of oxygen 42 from the oxygen regulator 14.

The mask 20 has provisions, generally indicated by phantom line 58, such as a microphone to establish voice communications with an intercom unit (ICU) 60 which is preferably lightweight and battery powered. The mask 20 preferably further comprises an adaptor 62, and fluid coupling means 64 having a connector 66 on one of its ends that is coupled to a drink facility 68. The drink facility 68 provides hot and/or cold liquids that are delivered to the aircrew, via elements 62, 64 and 66. The mask 20 further comprises devices, such as hose connectors, so as to accept one end of each of the fluid coupling means 70 and 72 that have their other end connected to the manifold 22.

In general, the manifold 22 has a first port 74, a second port 76, a third port 78, and a fourth port 80, with the first and third ports 74 and 78, respectively, serving as input ports and the second and fourth ports 76 and 80, respectively, serving as output ports. The first and second ports 74 and 76, respectively, have a one-way flow valve. The manifold 22 further comprises a switch handle 82, having means for carrying a duct that is selectable to establish fluid communications between the first and fourth ports 74 and 80, respectively, and between the second and third ports 76 and 78, respectively. The selectability allows for the respiratory system 10, in particular manifold 22, to allow the aircrew to transition between operational modes by a single motion of the selector switch so as to accommodate for failure conditions of the ventilator system 12 or of the oxygen regulator 14 in a manner to be described with reference to FIG. 8. The manifold 22 may be further described with reference to FIG. 2.

Figure 2:
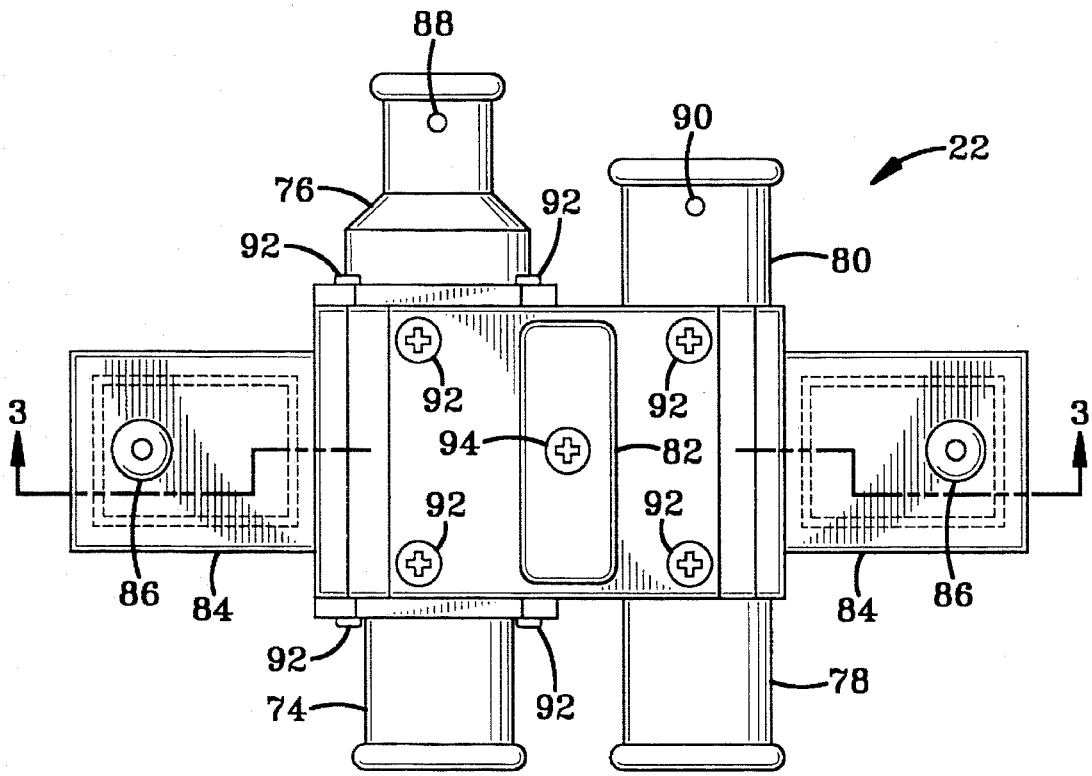
FIG. 2 is a plan view of the manifold of the present invention.

FIG. 2 illustrates the manifold 22 as preferably having an "H" shaped configuration and as being a four-port, crossover valve. The H-manifold 22 comprises a webbing 84 that carries a button-socket arrangement 86 which is used to mate with a complementary button-socket arrangement (not shown) carried by the vest 52 of FIG. 1. The complementary button arrangements are situated on the H-manifold 22 and the vest 52 so that the user, such as the aircrew, has easy and convenient access to the switch handle 82 to transition between ground and flight operational modes, and to respond to the failure conditions of the ventilator system 12 and the oxygen regulator 14.

As seen in FIG. 2, the second port 76 has a pin 88, whereas the fourth port 80 has a pin 90. The H-manifold 22 further comprises a plurality of screws 92 that are used to join together various components thereof. A screw 94 is used to connect the switch handle 82 to the manifold 22 that may be further described with reference: to FIG. 3, which is a view taken along line 3—3 of FIG. 2.

Figure 3:
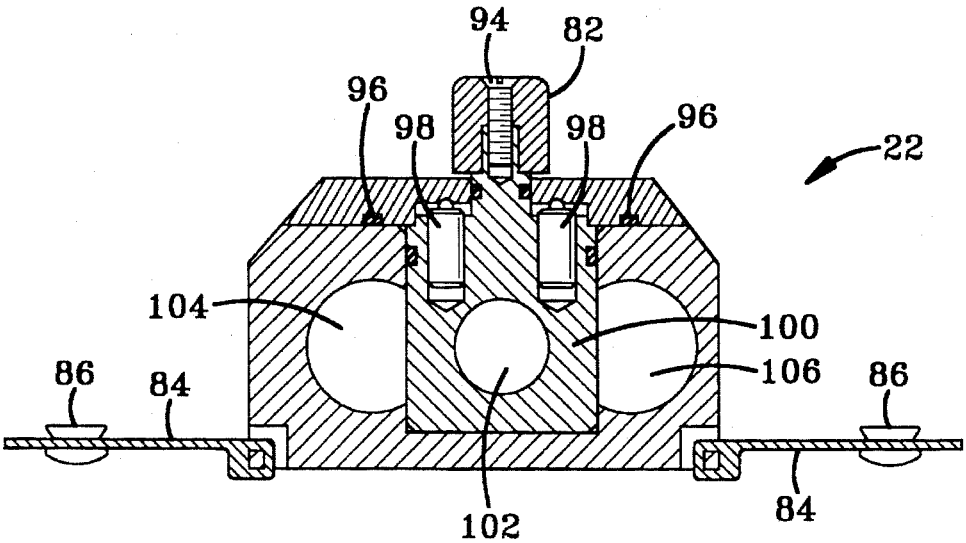
FIG. 3 is a view, taken along line 3–3 of FIG. 2, illustrating further details of the manifold of FIG. 2.

FIG. 3 illustrates, in cross-section, a face seal O-ring 96 and two plungers 98. The plungers 98 are inserted into a shaft 100 which also has to the switch handle 82 connected thereto via the screw 94. The shaft 100 carries a duct 102 which is switchable between chambers 104 and 106 respectively related to and interposed between the first and second ports 74 and 76, and between the third and fourth ports 78 and 80. The duct 102 is switchable by the rotation of shaft 100 which, in turn, is preferably rotated by the clockwise movement of the switch handle 82 and provides a detent action when switched. The shaft preferably provides ease of motion, but should provide adequate resistance such that, in conjunction with the detent feature, inadvertent actuation of the valve is prevented. The duct 102 may be further described with reference to FIG. 4 which is a view, in section, of the manifold 22 of FIG. 2.

Figure 4:
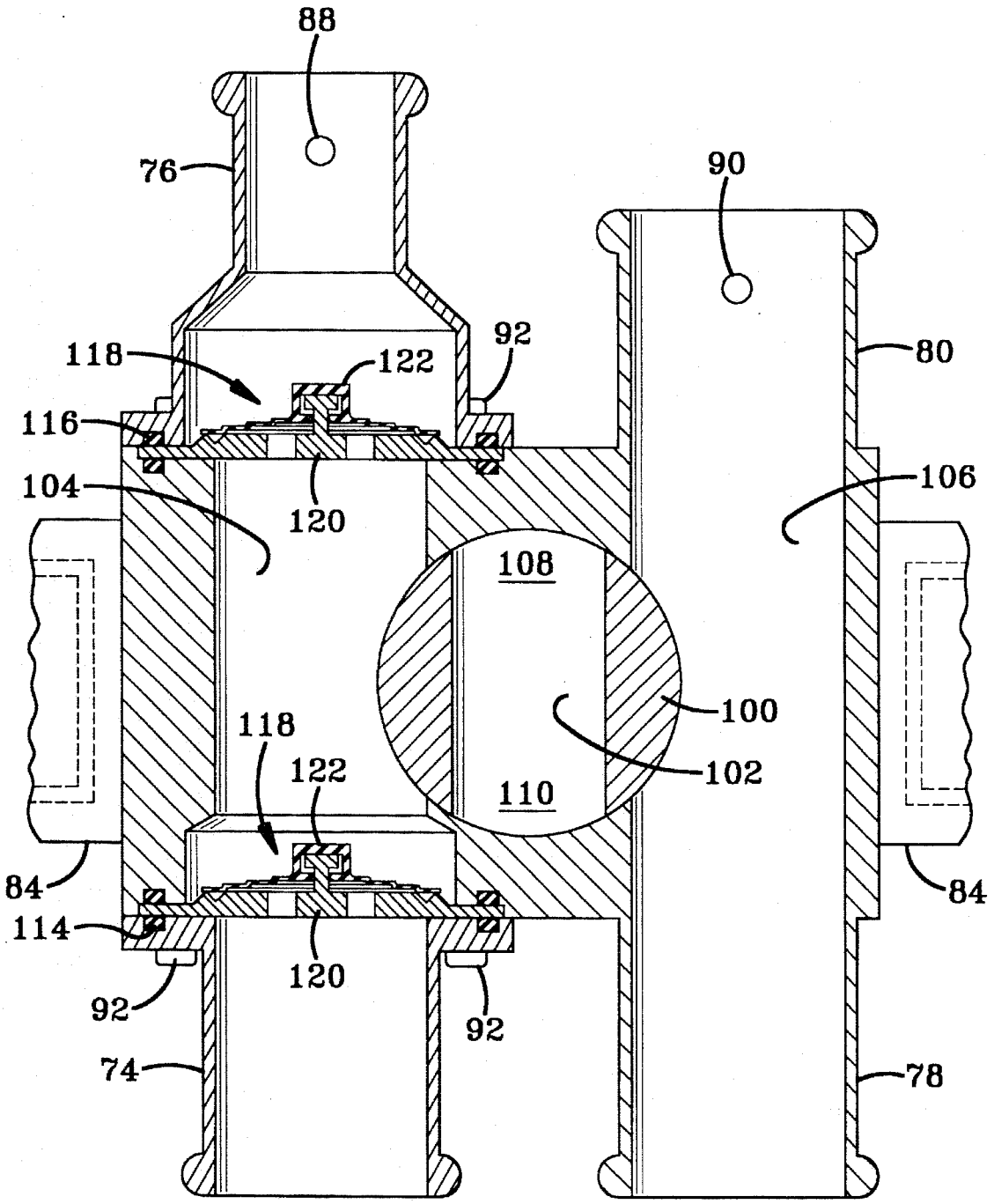
FIG. 4 is a view, in section, illustrating still further details of the manifold of FIG. 2.

FIG. 4 illustrates that the duct 102 comprises a first end 108 and a second end 110 which are preferably placed into chambers 106 and 104 by the clockwise rotation of the switch handle 82 of FIGS. 1–3. FIG. 4 further illustrates the first port 74 as having fastening means 112 and an O-ring 114, whereas the second port 76 is further illustrated as having an O-ring 116. The O-rings 114 and 116 mate with flapper-type, one-way flow valve 118 respectively situated in the first (74) and second (76) ports and each of which comprises a lower (as viewed in FIG. 4) valve seat 120 and an upper flapper valve 122. The flapper-type, one-way flow valve 118, in particular, the valve seat 120 may be further described with reference to FIG. 5 which is a top view thereof.

Figure 5:
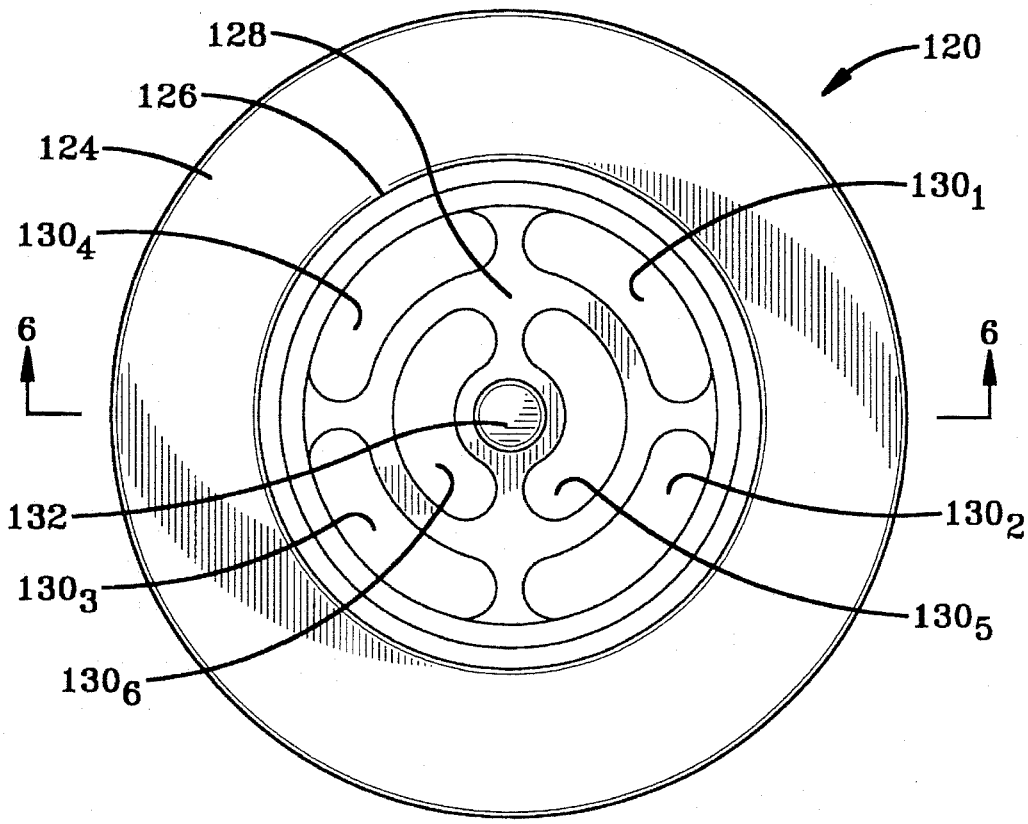
FIG. 5 is a top view of the valve seat which accommodates a flapper-type, one-way flow valve related to the present invention.

The valve seat 120 comprises three members, 124, 126 and 128, each preferably having a circular shape, and all arranged to have an abutting relationship as shown in FIG. 5. The circular member 128 is dimensioned and configured to provide a plurality of passageways $\mathbf{130_1}$, $\mathbf{130_2}$, $\mathbf{130_3}$, $\mathbf{130_4}$, $\mathbf{130_5}$, and $\mathbf{130_6}$, wherein the passageways $\mathbf{130_1}$, $\mathbf{130_2}$, $\mathbf{130_3}$ and $\mathbf{130_4}$ are near the outer edge of member 128 and the passageways $\mathbf{130_5}$ and $\mathbf{130_6}$ are near the inner edge of member 128. The member 128 carries a flapper valve mounting stem 130 which may be further described with reference to FIG. 6, which is a view taken along line 6—6 of FIG. 5.

Figure 6:
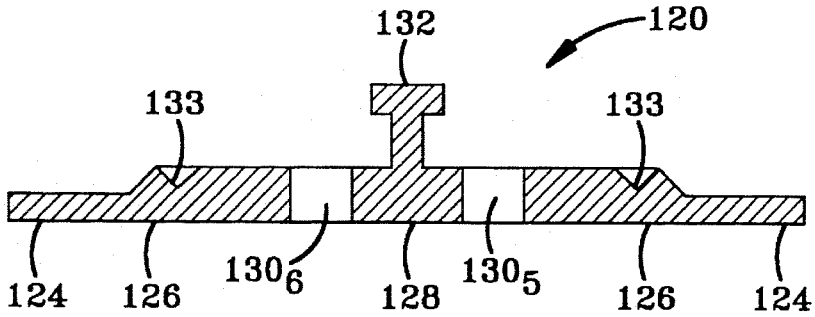
FIG. 6 is a view, taken along line 6—6 of FIG. 5, illustrating further details of the valve seat of FIG. 5.

As seen in FIG. 6, the flapper valve mounting stem 132 is preferably T-shaped in cross-section and is situated at the central region of the member 128. Further, FIG. 6 illustrates that the circular member 126 preferably has a cutout 133 formed therein. Further still, the T-shaped stem 132 is interposed between the inner passageways $\mathbf{130_5}$ and $\mathbf{130_6}$. The valve seat 120 of FIGS. 5 and 6 cooperates with the flapper valve 122 of FIG. 7 during the operation of the flapper-type, one-way flow valve 118.

Figure 7:
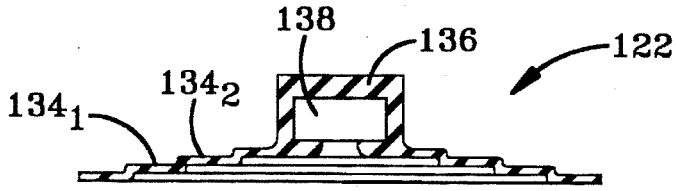
FIG. 7 is a view, in section, of the flapper valve related to the present invention.

FIG. 7 illustrates the flapper valve 122, which is comprised of a resilient material, such as rubber, and has a plurality of step portions $\mathbf{134_1}$ and $\mathbf{134_2}$. The flapper valve 122 of FIG. 7 is further arranged relative to the valve seat 120 so that its dome portion 136, in particular a slot portion 138 carried by the dome portion 136, is in correspondence with the stem 132 of the valve seat 120. The slot 138 is dimensioned so as to allow the insertion of stem 132 therein and free movement of the stem 132 within slot 138. The slot 138 is further preferably dimensioned so as to not allow the stem 132, except for its base, to come into direct contact with the slot 138. The operation of the flapper-type, one-way flow valve 118 comprising the valve seat and flapper valve 120 and 122, respectively, of FIGS. 4–7 may be further described with reference to FIG. 8.

Figure 8A:
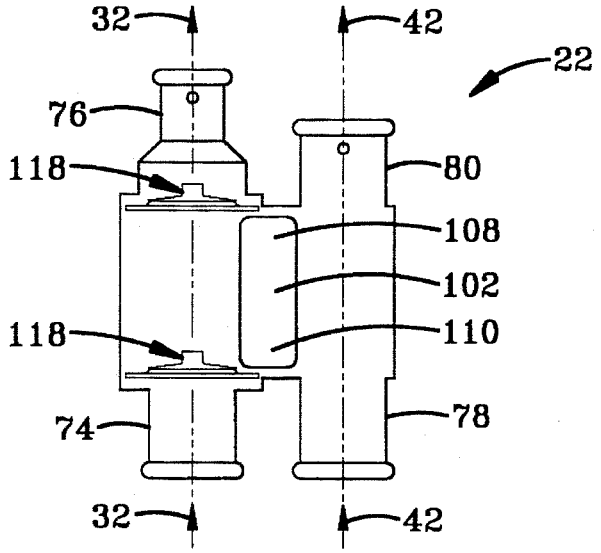
FIG. 8 is composed of FIGS. 8(A), (B), and (C) primarily illustrating the switchable duct of the manifold that is used to accommodate for failures of the ventilation and oxygen supply systems.
Figure 8B:
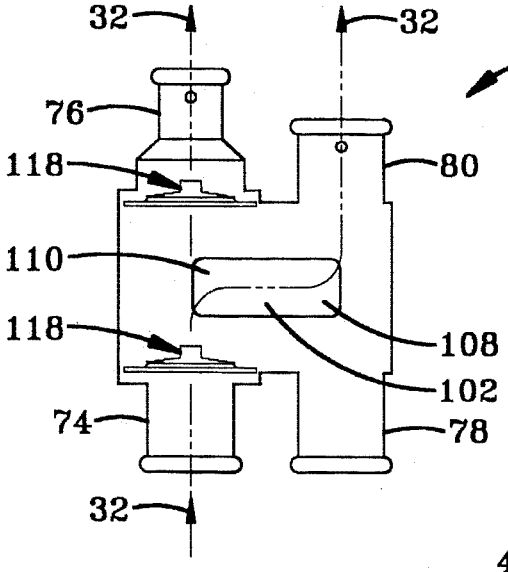
Figure 8C:
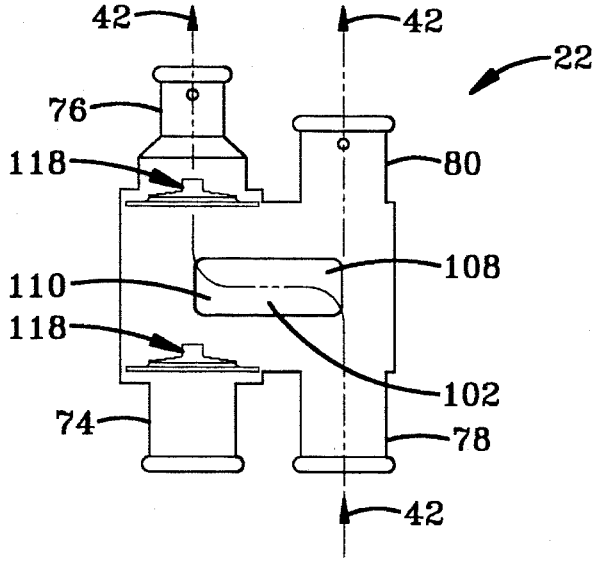

FIG. 8 is composed of FIGS. 8(A), 8(B), and 8(C) each of which schematically illustrates the location of one flapper-type, one-way flow valve 118 arranged at the first port 74 so as to serve as an input port one-way flow valve, and the other flapper-type, one-way flow valve 118 arranged at the output port 76 so as to serve the output port one-way flow valve. FIG. 8(A) also illustrates the location of the duct 102, controlled by the switch handle 82 (not shown), and the flapper-type, one-way flow valves 118 during the flight, non-failure, mode of operation of an aircraft and the respiratory system 10. FIG. 8(B) illustrates the location of the duct 102 and the flapper-type, one-way flow valves 118 during the ground mode of operation of the aircraft and respiratory system 10 and also during the failure mode of the oxygen regulator 14. FIG. 8(C), illustrates the location of the duct 102 and the flapper-type, one-way flow valves 118 during the failure mode of the ventilator system 12.

As seen in FIG. 8(A), each of the first, second, third and fourth ports 74, 76, 78 and 80 define a region and the duct 102 is located in the central region of the manifold 22 so as not to interfere with the flow of air 32 supplied by the ventilator system 12 nor with the flow of oxygen 42 supplied by the oxygen regulator 14. As further seen in FIG. 8(A), the flow of air 32 passes through the manifold 22 in straight-like manner and, similarly, the flow of oxygen 42 also passes through manifold 22 in a straight-like manner. Further, this passage of oxygen 42 and the means which provide this passage should be preferably dimensioned to prevent the cross-flow dilution of the pure oxygen supply. This non-disruptive passage is accomplished by the operation of each of the flapper-type, one-way flow valves 118 that responds to a pressure differential to provide for an open position to establish fluid communications between the first port 74 and the second port 76. More particularly, the flapper-type, one-way flow valve 118, arranged in the first inlet port 74, provides an open position when the pressure of the fluid entering the region of the first port 74 is greater than the pressure of the fluid exiting the region of the first port 74. In other words, if the flow of air 32 is flowing into the input port 74, the flapper valve 122 (see FIG. 7) lifts away from the valve seat 120 (see FIG. 5) to allow the flow of air 32 to flow through passageways $\mathbf{130_1}$ . . . $\mathbf{136_6}$ so as to provide for the open position. Similarly, the flapper-type, one-way flow valve 118, arranged in the output the port 76, provides an open position when the pressure of the fluid (flow of air 32) entering the second port region is greater than the pressure of the same fluid (flow of air 32) exiting its second port region. Again, the flapper valve 122 lifts away from the valve seat 120 to provide the open position. The input and output one-way flow valves 118 operate in unison to provide a flow of air 32 to the mask 20 of FIG. 1. Further, as seen in FIG. 8(A), the manifold 22 does not interfere with the flow of oxygen 42 so that it passes with minimal drop in pressure during typical flow conditions to the mask 20. The operation of the manifold 22 in response to an oxygen regulator 14 failure may be further described with reference to FIG. 8(B).

As seen in FIG. 8(B), the duct 102 is positioned by the clockwise rotation of the switch handle 82 (not shown) so that end 110 of duct 102 is interposed so as to intercept the flow of air 32 and to direct a portion of such flow of air 32 to the second end 108 of duct 102 so that there is a fluid communication path provided between the first port 74 and the fourth port 80 as shown in FIG. 8(B). It should be noted that the non-diverted portion of the flow of air 32 not intercepted by duct 102 passes to the output port 76. Accordingly, even though an oxygen regulator 14 failure may have occurred, the present invention provides for the switching of the duct 102 to allow the ventilated flow of air 32 to be delivered to both the hood 16 and mask 20, thereby, temporarily providing the aircrew with uncontaminated breathable air in spite of the failed oxygen supply. The response provided by the manifold 22, in particular the switchable duct 102, to a ventilator system 12 failure may be further described with reference to FIG. 8(C).

As seen in FIG. 8(C), the duct 102 is positioned by the clockwise rotation of switch handle 82 (not shown) so as to intercept the flow of oxygen 42 that enters the third port 78 and providing fluid communication between the third port 78 and the second port 76. For such positioning, the hood 16 and the mask 18 is provided with a flow of oxygen 42 for both its air and oxygen fluid communication paths. For the operation shown in FIG. 8(C), the flapper-type, one-way flow valve 118, located in the first input port 74 is in a closed condition, thereby, preventing any of the oxygen that is entering the third port 78 from flowing into the failed ventilator system 12 of FIG. 1 by way of the input port 74. Such prevention is accomplished by the valve seat 120 and the flapper valve 122 (see FIGS. 4–7) mating with each other and closing off the passageways $\mathbf{130_1}$ . . . $\mathbf{130_6}$ due to the interaction of the step portions $\mathbf{134_1}$ and $\mathbf{134_2}$. This mating is accomplished because the pressure of the fluid entering into the first port 74 is less than the pressure existing in the remainder of the first port 74. More particularly, because of the presence of the flow the oxygen 42 in the confines of the manifold 22 that includes the region on top (as viewed in FIG. 8(C)) of the flapper valve 122 of the flapper-type, one-way flow valve arranged in port 74, the pressure on top of the flapper valve 122 exceeds that of the pressure being sensed by the valve seat 120, so as to provide a downward force onto the valve seat 120, thereby, causing a merger or closure between the valve seat and flapper valve 120 and 122, respectively. It should be noted that the switch handle 82 (not shown) need only be rotated in one direction, preferably clockwise, to accommodate for both of the failures shown in FIGS. 8(A) and 8(B). This one-switch, one-position advantageously reduces the amount of effort required by the aircrew to respond to a fault condition and reduces the possibility of error.

It should now be appreciated that the practice of the present invention provides for a respiratory system 10 having a manifold 22 that includes a single switch handle that is operated so as to respond to the failure conditions of the ventilator system 12 or to the oxygen regulator 14 so as to provide a user with either a flow of uncontaminated air or a flow of oxygen both of the fluid communication paths related to the ventilator and oxygen supply systems.

Although the hereinbefore given description of the respiratory system 10 was primarily directed to its use during ground and flight operations for the aircrew, it should be appreciated that the principles of the present invention are equally applicable to other commercial applications that require a respiratory system to provide a flow of either a current of air or a current of oxygen to individuals during the failure conditions related to ventilator or oxygen supply systems.

Many modifications or variations of the present invention are possible in view of the above disclosure. It is, therefore, to be understood, that within the scope of the appended claims, the invention may be practiced otherwise as specifically described.

What we claim is:

1. A respirator system for a user comprising:

(a) means for supplying a flow of oxygen;

(b) means for supplying a flow of air;

(c) a manifold having a first, second, third and fourth ports with the first and third ports serving as input ports and the second and fourth ports serving as output ports, said first and third ports and said second and fourth ports having fluid communication respectively therebetween, said first and second ports each having a one-way flow valve, said manifold having a switch with means for carrying a duct that is selectable to break said fluid communications between said first and third ports and between said second and fourth ports and establish fluid communications between said first and fourth ports and between said second and third ports;

(d) a hood and a mask with the hood having a transparent window, said hood covering a head and neck of a user with the transparent window being arranged in the general region of eyes of a user, said mask covering a user's mouth and nose; and (e) fluid coupling means for coupling said first port to said means for supplying a flow of air, said third port to said means for supplying a flow of oxygen, and both said second and fourth ports to said mask.

2. The respiratory system according to claim 1, wherein said means for supplying a flow of air is self contained and portable.

3. The respiratory system according to claim 1, wherein each of said one-way flow valves of said manifold comprises:

(a) a valve seat having a plurality of passageways spaced apart from each other and a stem that extend from a surface of said valve seat; and (b) a flapper valve of a resilient material and having a plurality of stepped portions, said flapper valve having a slot therein that is in correspondence with said stem of said valve seat and is dimensioned so that said stem may move therein.

4. The respiratory system according to claim 1, wherein said means for carrying said duct comprises a shaft having a grippable handle connected at one of its ends, said handle being rotatable so as to establish said fluid communications between said first and fourth ports and between said second and third ports.

5. A respirator system comprising:

(a) means for supplying a flow of oxygen;

(b) means for supplying a flow of air;

(c) a manifold having first, second, third and fourth ports each defining a respective region and with the first and third ports serving as input ports and the second and fourth ports serving as output ports, said first and third ports and said second and fourth ports having fluid communication respectively therebetween, said first and second ports each having a one-way flow valve, each of said one-way flow valves being responsive to a pressure differential and respectively providing an open position to establish fluid communications between said first and second ports when the pressure of the fluid entering the first port region is greater than the pressure of the fluid exiting said first port region and the pressure of the fluid entering the second port region is greater than the pressure of the fluid exiting the second port region, said manifold having a switch with means for carrying a duct that is selectable to break said fluid communication between said first and third ports and between said second and fourth ports and establish fluid communications between said first and fourth ports and between said second and third ports;

(d) a hood and mask with the hood having a transparent window, said hood covering a head and neck of a user with the transparent window being arranged in the general region of eyes of a user, said mask covering a user's mouth and nose; and (e) fluid coupling means for coupling said first port to said means for supplying a flow of air, said third port to said means for supplying a flow of oxygen, and both said second and fourth ports to said mask.

6. The respiratory system according to claim 5, wherein said means for supplying a flow of air is self contained and portable.

7. The respiratory system according to claim 5, wherein said hood, said mask and said manifold each comprises a chemically impervious material.

8. A respiratory system comprising:

(a) means having operative and inoperative conditions for supplying a flow of oxygen;

(b) means having operative and inoperative conditions for supplying a flow of air;

(c) a manifold having first, second, third and fourth ports each defining a respective region and with the first and third ports serving as input ports and the second and fourth ports serving as output ports, said first and third ports and said second and fourth ports having fluid communication respectively therebetween, said first and second ports each having a one-way flow valve, each of said one-way flow valves being responsive to a pressure differential and respectively providing an open position to establish fluid communications between said first and second ports when the pressure of the fluid entering said first port region is greater than the pressure of the fluid exiting said first port region and the pressure of the fluid entering the second port region is greater than the pressure of the fluid exiting the second port region, said manifold having a switch with means for carrying a duct that is selectable to break said fluid communication between said first and third ports and between said second and fourth ports and establish fluid communications between said first and fourth ports and between said second and third ports;

(d) a hood and mask with the hood having a transparent window, said hood covering a head and neck of a user with the transparent window being arranged in the general region of eyes of a user, said mask covering a user's mouth and nose; and (e) fluid coupling means for coupling said first port to said means for supplying a flow of air, said third port to said means for supplying a flow of oxygen, and both said second and third ports to said mask, wherein said duct is selectable to establish fluid communication between said first and fourth ports when said means for supplying a flow of oxygen is in its inoperative condition and said duct is selectable to establish fluid communication between said second and third ports when said means for supplying a flow of air is in its inoperative condition.

9. The respiratory system according to claim 8, wherein said means for supplying a flow of air is self contained and portable.

10. The respiratory system according to claim 8, wherein said transparent window comprises a chemically impervious material.

* * * * *